US007029010B2

(12) United States Patent
Hubert

(10) Patent No.: US 7,029,010 B2
(45) Date of Patent: Apr. 18, 2006

(54) GAME OF DONUTS

(75) Inventor: Robert Curtis Hubert, # 19 Conners Cresent, Red Deer, Alberta (CA) T4P 2E4

(73) Assignee: Robert Curtis Hubert, Red Deer (CA)

( * ) Notice: Subject to any disclaimer, the term of this patent is extended or adjusted under 35 U.S.C. 154(b) by 15 days.

(21) Appl. No.: 10/846,411

(22) Filed: May 17, 2004

(65) Prior Publication Data

US 2005/0110213 A1 May 26, 2005

(51) Int. Cl.
*A63F 3/00* (2006.01)

(52) U.S. Cl. ..... 273/258; 273/249

(58) Field of Classification Search ..... 273/249, 273/258; D21/343

See application file for complete search history.

(56) References Cited

U.S. PATENT DOCUMENTS

| | | | | | |
|---|---|---|---|---|---|
| D218,692 | S | * | 9/1970 | McSweeney | D10/46.1 |
| D263,061 | S | * | 2/1982 | Lease | D10/46.1 |
| 5,590,883 | A | * | 1/1997 | Brewer | 273/249 |
| D441,803 | S | * | 5/2001 | Streifel | D21/343 |

* cited by examiner

*Primary Examiner*—Vishu K. Mendiratta

(57) ABSTRACT

The invention is a combined card, dice, and peg board game which 3 to 6 players can play. It consists of one peg board with two start/finish lines, two separate start/finish areas, and four pegging tracks within the outline of the game's name. On each pegging track are a plurality of "donut!" circles separated from each other by the same number of peg holes. Equipment for the game includes a deck of 52 cards of 4 aces through 4 duces, one pair of dice, six pairs of different colored pegs, one rule booklet, and a pad of game tracking sheets. As players accumulate tricks, make their bid, and land on "donut!" circles, they peg points towards the finish. The first player to cross the designated finish line wins the game. The invention is a fun game of bidding strategy and surprise.

1 Claim, 10 Drawing Sheets

| **donuts!** Tracking Sheet 3-4 PLAYER GAME | | | Players 1 | 2 | 3 | 4 | 5 | 6 | | |
|---|---|---|---|---|---|---|---|---|---|---|
| | | | JOHN | SUE | BILL | MARY | | | | |
| Rnd # | Cards Dealt | Power Suit | Bid | Bid | Bid | Bid | Bid | Bid | Sum of First Bids | Dealer cannot Bid |
| 1 | 13 | ♦ | 14 | | 13 | 13 | | | 9 | 4 |
| 2 | 12 | ♣ | | 12 | 13 | 15 | | | 10 | 2 |
| 3 | 11 | ♥ | | 13 | | 12 | | | 6 | 5 |
| 4 | 10 | ♠ | 12 | | 12 | | | | 6 | 4 |
| 5 | 9 | N | 11 | 11 | | 14 | | | 9 | 0 |
| 6 | 8 | ♦ | | 12 | 12 | | | | 5 | 3 |
| 7 | 7 | ♣ | | 10 | 11 | 12 | | | 5 | 2 |
| 8 | 6 | ♥ | 13 | 12 | 11 | | | | 4 | 2 |
| 9 | 5 | ♠ | 11 | | | 10 | | | 3 | 2 |
| 10 | 4 | N | | 10 | 10 | 12 | | | 1 | 3 |
| 11 | 3 | ♦ | 10 | 11 | 11 | | | | 2 | 1 |
| 12 | 2 | ♣ | 0 | 1 | 0 | 0 | | | 1 | 1 |
| 13 | 1 | ♥ | | | | | | | | |
| 14 | 2 | ♠ | | | | | | | | |
| 15 | 3 | N | | | | | | | | |
| 16 | 4 | ♦ | | | | | | | | |
| 17 | 5 | ♣ | | | | | | | | |
| 18 | 6 | ♥ | | | | | | | | |
| 19 | 7 | ♠ | | | | | | | | |
| 20 | 8 | N | | | | | | | | |
| 21 | 9 | ♦ | | | | | | | | |
| 22 | 10 | ♣ | | | | | | | | |
| 23 | 11 | ♥ | | | | | | | | |
| 24 | 12 | ♠ | | | | | | | | |
| 25 | 13 | N | | | | | | | | |
| 26 | 12 | ♦ | | | | | | | | |
| 27 | 11 | ♣ | | | | | | | | |
| 28 | 10 | ♥ | | | | | | | | |

FIG. 6A

| **donuts!** **Tracking Sheet** 3-4 PLAYER GAME | | | Players 1 | 2 | 3 | 4 | 5 | 6 | | |
|---|---|---|---|---|---|---|---|---|---|---|
| Rnd # | Cards Dealt | Power Suit | Bid | Bid | Bid | Bid | Bid | Bid | Sum of First Bids | Dealer cannot Bid |
| 1 | 13 | ♦ | | | | | | | | |
| 2 | 12 | ♣ | | | | | | | | |
| 3 | 11 | ♥ | | | | | | | | |
| 4 | 10 | ♠ | | | | | | | | |
| 5 | 9 | N | | | | | | | | |
| 6 | 8 | ♦ | | | | | | | | |
| 7 | 7 | ♣ | | | | | | | | |
| 8 | 6 | ♥ | | | | | | | | |
| 9 | 5 | ♠ | | | | | | | | |
| 10 | 4 | N | | | | | | | | |
| 11 | 3 | ♦ | | | | | | | | |
| 12 | 2 | ♣ | | | | | | | | |
| 13 | 1 | ♥ | | | | | | | | |
| 14 | 2 | ♠ | | | | | | | | |
| 15 | 3 | N | | | | | | | | |
| 16 | 4 | ♦ | | | | | | | | |
| 17 | 5 | ♣ | | | | | | | | |
| 18 | 6 | ♥ | | | | | | | | |
| 19 | 7 | ♠ | | | | | | | | |
| 20 | 8 | N | | | | | | | | |
| 21 | 9 | ♦ | | | | | | | | |
| 22 | 10 | ♣ | | | | | | | | |
| 23 | 11 | ♥ | | | | | | | | |
| 24 | 12 | ♠ | | | | | | | | |
| 25 | 13 | N | | | | | | | | |
| 26 | 12 | ♦ | | | | | | | | |
| 27 | 11 | ♣ | | | | | | | | |
| 28 | 10 | ♥ | | | | | | | | |

FIG. 6C

| **donuts!** **Tracking Sheet** 5 PLAYER GAME | | | Players 1 | 2 | 3 | 4 | 5 | 6 | | |
|---|---|---|---|---|---|---|---|---|---|---|
| Rnd # | Cards Dealt | Power Suit | Bid | Bid | Bid | Bid | Bid | Bid | Sum of First Bids | Dealer cannot Bid |
| 1 | 10 | ♦ | | | | | | | | |
| 2 | 9 | ♣ | | | | | | | | |
| 3 | 8 | ♥ | | | | | | | | |
| 4 | 7 | ♠ | | | | | | | | |
| 5 | 6 | N | | | | | | | | |
| 6 | 5 | ♦ | | | | | | | | |
| 7 | 4 | ♣ | | | | | | | | |
| 8 | 3 | ♥ | | | | | | | | |
| 9 | 2 | ♠ | | | | | | | | |
| 10 | 1 | N | | | | | | | | |
| 11 | 2 | ♦ | | | | | | | | |
| 12 | 3 | ♣ | | | | | | | | |
| 13 | 4 | ♥ | | | | | | | | |
| 14 | 5 | ♠ | | | | | | | | |
| 15 | 6 | N | | | | | | | | |
| 16 | 7 | ♦ | | | | | | | | |
| 17 | 8 | ♣ | | | | | | | | |
| 18 | 9 | ♥ | | | | | | | | |
| 19 | 10 | ♠ | | | | | | | | |
| 20 | 9 | N | | | | | | | | |
| 21 | 8 | ♦ | | | | | | | | |
| 22 | 7 | ♣ | | | | | | | | |
| 23 | 6 | ♥ | | | | | | | | |
| 24 | 5 | ♠ | | | | | | | | |
| 25 | 4 | N | | | | | | | | |
| 26 | 3 | ♦ | | | | | | | | |
| 27 | 2 | ♣ | | | | | | | | |
| 28 | 1 | ♥ | | | | | | | | |

FIG. 6D

| **donuts!** **Tracking Sheet** 6 PLAYER GAME | | | Players 1 | 2 | 3 | 4 | 5 | 6 | | |
|---|---|---|---|---|---|---|---|---|---|---|
| Rnd # | Cards Dealt | Power Suit | Bid | Bid | Bid | Bid | Bid | Bid | Sum of First Bids | Dealer cannot Bid |
| 1 | 8 | ♦ | | | | | | | | |
| 2 | 7 | ♣ | | | | | | | | |
| 3 | 6 | ♥ | | | | | | | | |
| 4 | 5 | ♠ | | | | | | | | |
| 5 | 4 | N | | | | | | | | |
| 6 | 3 | ♦ | | | | | | | | |
| 7 | 2 | ♣ | | | | | | | | |
| 8 | 1 | ♥ | | | | | | | | |
| 9 | 2 | ♠ | | | | | | | | |
| 10 | 3 | N | | | | | | | | |
| 11 | 4 | ♦ | | | | | | | | |
| 12 | 5 | ♣ | | | | | | | | |
| 13 | 6 | ♥ | | | | | | | | |
| 14 | 7 | ♠ | | | | | | | | |
| 15 | 8 | N | | | | | | | | |
| 16 | 7 | ♦ | | | | | | | | |
| 17 | 6 | ♣ | | | | | | | | |
| 18 | 5 | ♥ | | | | | | | | |
| 19 | 4 | ♠ | | | | | | | | |
| 20 | 3 | N | | | | | | | | |
| 21 | 2 | ♦ | | | | | | | | |
| 22 | 1 | ♣ | | | | | | | | |
| 23 | 2 | ♥ | | | | | | | | |
| 24 | 3 | ♠ | | | | | | | | |
| 25 | 4 | N | | | | | | | | |
| 26 | 5 | ♦ | | | | | | | | |
| 27 | 6 | ♣ | | | | | | | | |
| 28 | 7 | ♥ | | | | | | | | |

FIG. 6E

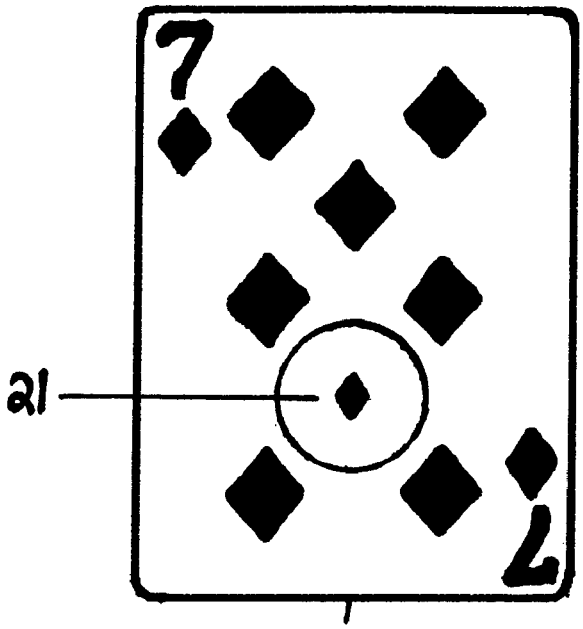
FIG. 7
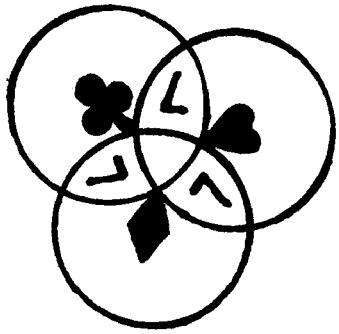
FIG. 8
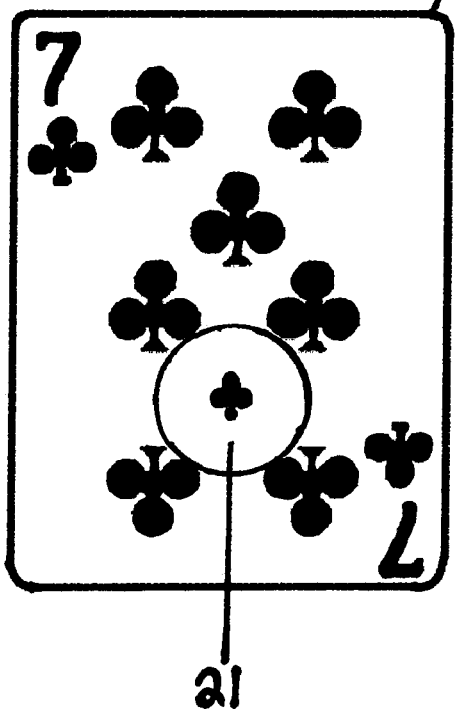
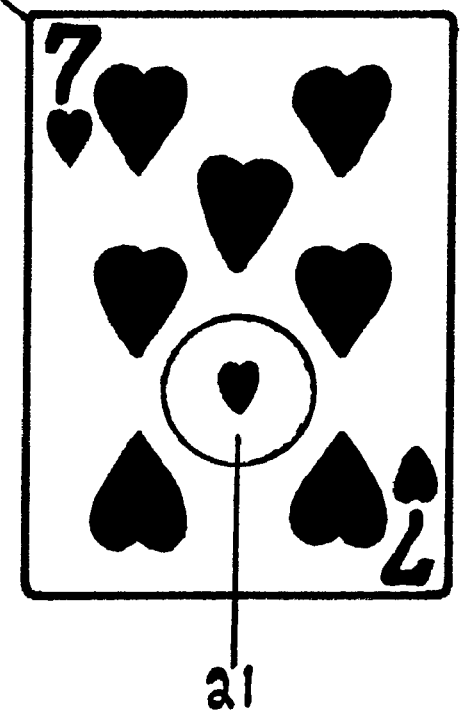

GAME OF DONUTS

RELATED APPLICATIONS

Not Applicable

FEDERALLY SPONSORED RESEARCH OR DEVELOPMENT

Not Applicable

LISTINGS OR TABLES ON COMPACT DISK

Not Applicable

REFERENCE TO A MICRO-FICHE APPENDIX

Not Applicable

BACKGROUND OF THE INVENTION

Peg board games have long been known and have been played by numerous people around the world. Peg board games such as Cribbage, the simple game of Tic Tac Toe, or the popular 70's game of Mastermind can be mentioned as examples. The card playing and peg board game of cribbage was believed to be invented over 3 centuries ago in the early 1600's. Over the years many variations and styles to the cribbage peg board have been invented which have similarities to the peg board component of the invention. Some examples of these cribbage peg board variations as cross referenced in U.S. patent documents are as follows:

| | |
|---|---|
| U.S. Pat. No. 5,590,883 | Brewer |
| U.S. Pat. No. 5,498,005 | Jacques |
| U.S. Pat. No. 4,902,018 | Morse |
| U.S. Pat. No. 2,415,073 | Buffmire |
| U.S. Pat. No. 695,303 | Graham |
| U.S. Pat. No. D441,803 | Streifel |
| U.S. Pat. No. 3,347,460 | Dickson |
| U.S. Pat. No. 2,223,175 | Ink |
| U.S. Pat. No. 4,598,912 | Kendrick et al |
| U.S. Pat. No. 2,477,825 | Richardson |
| U.S. Pat. No. 3,695,512 | Trudel |

Similarly, many card games have been invented and played by people for centuries. According to The United States Playing Card Company, the earliest documented history of card playing was believed to have originated in central Asia in the $10^{th}$ century where the Chinese began using paper dominoes by shuffling and dealing them like cards. Eventually four-suited decks evolved in the Moslem world and were imported by Europeans. With the invention of woodcuts in the 14th century, Europeans began mass card production, and with this came the development of numerous card games.

Some examples of trick capturing card games similar to the invention include Rook, Hearts, Euchre, Whist, Bridge and Spades. Some examples of card games as cross referenced in U.S. patent documents are as follows:

| | |
|---|---|
| U.S. Pat. No. 5,954,334 | Parker, Jr. |
| U.S. Pat. No. 6,543,774 | Taylor |
| U.S. Pat. No. 6,003,870 | Johnson |
| U.S. Pat. No. 6,155,567 | Keleher |

-continued

| | |
|---|---|
| U.S. Pat. No. 5,375,845 | Cooter et al. |
| U.S. Pat. No. 5,112,059 | Mundle et al. |
| U.S. Pat. No. 5,125,667 | Richards |
| U.S. Pat. No. 4,071,247 | Breslow |
| U.S. Pat. No. 4,332,386 | Townsend |
| U.S. Pat. No. 4,195,767 | Harden |
| U.S. Pat. No. 1,656,993 | Searle |

Some examples of cribbage peg board variations as cross referenced in Foreign Canadian Patent documents are as follows:

| | |
|---|---|
| #CA 2,369,219 | Droppo/Dunning |
| #CA 1,230,585 | Blais |
| #CA 1,202,283 | Yakich |
| #CA 1,195,001 | Mah |
| #CA 1,120,507 | Rintoul |
| #CA 1,020,919 | Cyre |
| #CA 914,632 | Mackenzie/Klemm |
| #CA 705,250 | Bradley |
| #CA 560,243 | Pepin |
| #CA 531,003 | Kaun |
| #CA 493,310 | Stackhouse |
| #CA 497,126 | Lupton |
| #CA 481,170 | Hicks |
| #CA 469,439 | Tweed/Tweed |
| #CA 436,802 | Brooks |
| #CA 369,282 | Robitaille/Muggah |
| #CA 320,055 | Brophy |

Some examples of card games as cross referenced in Foreign Canadian Patent documents are as follows:

| | |
|---|---|
| #CA 2,243,384 | Placid |
| #CA 2,096,288 | Ross/Ross/Foster/Czarnecki |
| #CA 1,299,596 | Staysko/Staysko |
| #CA 931,181 | Breslow |
| #CA 369,680 | Stone/Freiman |
| #CA 369,016 | Stone/Freiman |
| #CA 334,165 | Paul |
| #CA 1,167,076 | Poirier/Zacher |
| #CA 1,081,725 | Gerard |
| #CA 1,057,322 | Magiera |

Consequently, the background of this invention was derived from a number of different ideas from different game concepts. In regard to trick capturing card games however, the game of donuts! is different because:

a) the number of cards dealt to each player changes by 1 numerical value (or by 1 card) from one round to the next as the game progresses.

b) in every round of play the dealer offsets the bidding total from the trick total. Doing this ensures that at least one player will not make their bid in every round.

c) the game utilizes a peg board that provides bidding strategies and pegging opportunities for players in almost every round of play.

d) pegging on the peg board is achieved when players make their bid, shake the dice, and hit donut! circles on the peg board.

Even though many card games and/or peg board games have achieved considerable popularity and success on their own, I believe there is a market for the game of donuts! that encompasses dice, cards, card playing ability and bidding strategy in conjunction with the peg board component of the invention.

SUMMARY OF THE INVENTION

Considered broadly, games according to the invention are specifically a combination of the peg board type and of the card game type. Typically the peg board according to the invention is made from wood or from molded or injected plastic material.

The peg board component of the invention is designed to track each player's progress in the game, and provides bidding strategies for all players before each round of play. On each of the 4 pegging tracks are thirteen "donut!" circles which are separated from one another on the tracks by six peg holes. The invention has two start/finish areas and two start/finish lines as the game can be played in either a forwards or backwards direction. One start/finish area is located on one side of the peg board and the other start/finish area is located on the opposite side of the peg board. Both start/finish areas comprise a total of eleven peg holes and one start/finish line. When a start/finish area on the peg board is designated as the finishing area of the game, all eleven peg holes within this area act as a final singular pegging track. When a start/finish area has been designated as the starting area for the game, eight of the eleven peg holes in this area are used as the starting points for the pegs, and the other three remaining holes in this starting area are not utilized. As players make their bid, shake the dice, and land on donut! circles on their pegging tracks, they peg points towards the designated finish line for that game. The first player to cross the finish line wins the game.

The game tracking sheet component of the invention is utilized to record players' names, the number of cards dealt to each player in each round, players' bids, each players' pegging score, and other important information to keep track of the game.

The rule book component of the invention is utilized by all players to understand how to play the game.

BRIEF DESCRIPTION OF THE DRAWINGS

In each of the drawings, the invention is comprised of:

a) one donuts! peg board (FIG. 1), b) game tracking sheets (FIG. 2), c) a deck of 52 cards consisting of 4 aces through 4 duces (FIG. 3), d) one pair of dice (FIG. 4), e) six pairs of different coloured pegs (FIG. 5), f) one rule book (FIG. 6), g) a rule book diagram of a 4 Player tracking sheet in progress (FIG. 6A), h) a rule book diagram of the donuts! pegboard (FIG. 6B), i) a rule book diagram of the 3 and 4 player tracking sheet (FIG. 6C), j) a rule book diagram of the 5 player tracking sheet (FIG. 6D), k) a rule book diagram of the 6 player tracking sheet (FIG. 6E), l) three specific donut! cards (FIG. 7), m) a donuts! game logo (FIG. 8).

DETAILED DESCRIPTION OF THE INVENTION

Figure 1:
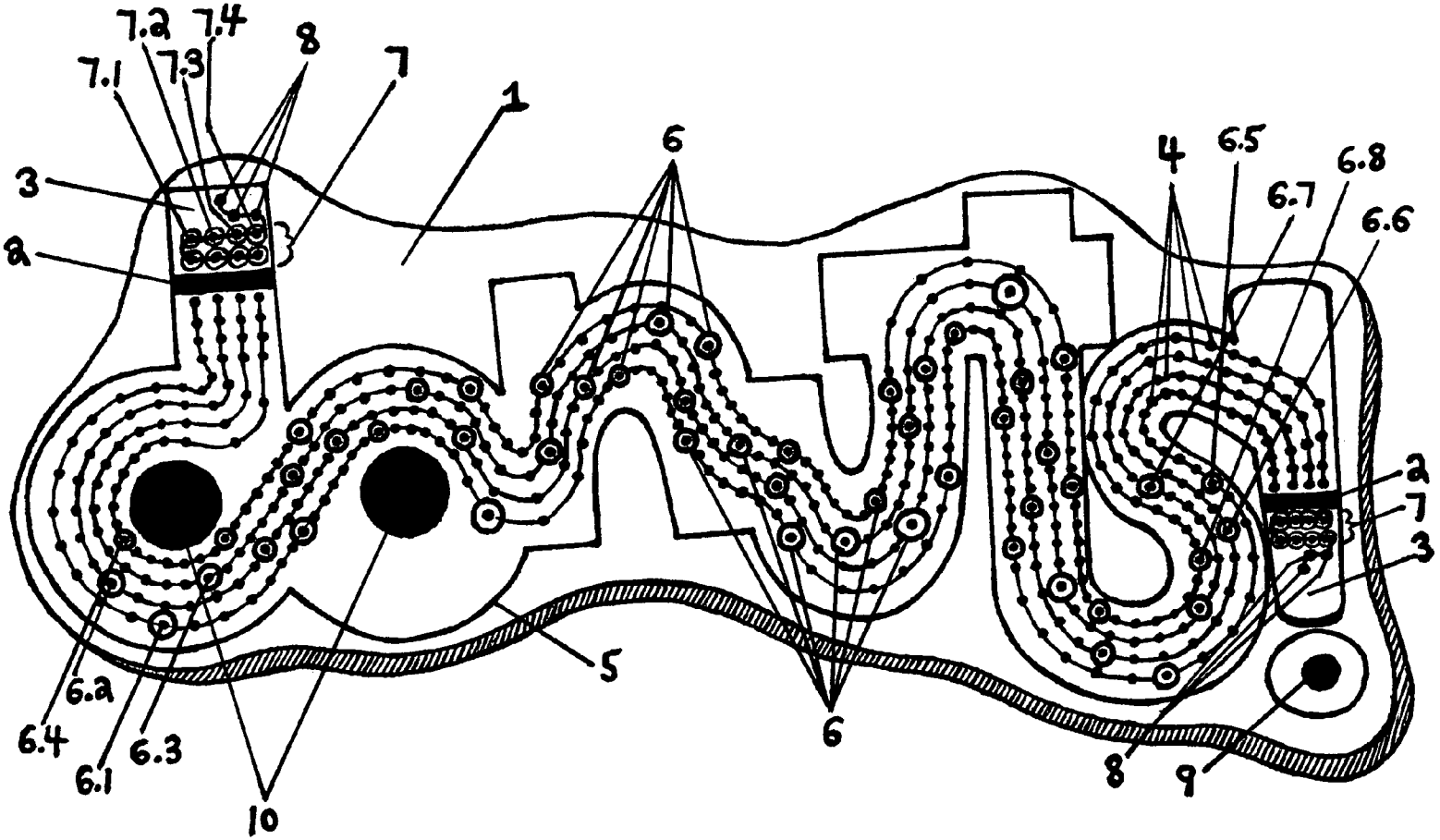

The drawing in FIG. 1 illustrates embodiments of the donuts! peg board 1 which is made from wood and/or molded plastic or injected plastic material ¾ of an inch thick. The donuts! peg board itself is approximately 15 inches in length and 5 and a half inches wide at its farthest points, and each of the peg holes are drilled into the board at a depth of ⅜" and a diameter of ⅛ of an inch.

On either end of the peg board are two start/finish lines 2 that separate both of the start/finish areas 3 from the four pegging tracks on the peg board 4. Each pegging track consists of 120 peg holes, and each of the four tracks wind across the peg board within an outline of the game's name 5. All 120 peg holes on each pegging track are connected to one another by a continuous track line from one side of the peg board to the other. Thus there are four separate and distinct pegging tracks. Along the track lines of each pegging track are a plurality of "donut!" circles that surround a plurality of peg holes 6.

As illustrated in FIG. 1, each donut! circle is separated from the next donut! circle on its pegging track by six unmarked peg holes. The total number of donut! circles on each pegging track is thirteen, and the total number of donut! circles on the entire peg board is fifty-two.

When a donuts! game is started on the letter "d" of the peg board:

The first donut! circle on track one begins on the $18^{th}$ peg hole 6.1 after this start/finish line. All subsequent donut! circles on this track occur on the $25^{th}$, $32^{nd}$, $39^{th}$, $46^{th}$, $53^{rd}$, $60^{th}$, $67^{th}$, $74^{th}$, $81^{st}$, $88^{th}$, $95^{th}$, and $102^{nd}$ peg holes. Each donut! circle on track one is yellow in colour.

The first donut! circle on track two begins on the $16^{th}$ peg hole 6.2 after this start/finish line. All subsequent donut! circles on this track occur on the $23^{rd}$, $30^{th}$, $37^{th}$, $44^{th}$, $51^{st}$, $58^{th}$, $65^{th}$, $72^{nd}$, $79^{th}$, $86^{th}$, $93^{rd}$, and $100^{th}$ peg holes. Each donut! circle on track two is green in colour.

The first donut! circle on track three begins on the $20^{th}$ peg hole 6.3 after this start/finish line. All subsequent donut! circles on this track occur on the $27^{th}$, $34^{th}$, 41st, $48^{th}$, $55^{th}$, $62^{nd}$, $69^{th}$, $76^{th}$, $83^{rd}$, $90^{th}$, $97^{th}$, and $104^{th}$ peg holes. Each donut! circle on track three is blue in colour.

The first donut! circle on track four begins on the $15^{th}$ peg hole 6.4 after this start/finish line. All subsequent donut! circles on this track occur on the $22^{nd}$, $29^{th}$, $36^{th}$, $43^{rd}$, $50^{th}$, $57^{th}$, $64^{th}$, $71^{st}$, $78^{th}$, $85^{th}$, $92^{nd}$, and $99^{th}$ peg holes. Each donut! circle on track four is red in colour.

When a game is started on the exclamation mark ("!") of the peg board:

The first donut! circle on track one begins on the $19^{th}$ peg hole 6.5 after this start/finish line. All subsequent donut! circles on this track occur on the $26^{th}$, $33^{rd}$, $40^{th}$, $47^{th}$, $54^{th}$, $61^{st}$, $68^{th}$, $75^{th}$, $82^{nd}$, $89^{th}$, $96^{th}$, and $103^{rd}$ peg holes. Each of the donut! circles on track one are yellow in colour.

The first donut! circle on track two begins on the $21^{st}$ peg hole 6.6 after this start/finish line. All subsequent donut! circles on this track occur on the $28^{th}$, $35^{th}$, $42^{nd}$, $49^{th}$, $56^{th}$, $63^{rd}$, $70^{th}$, $77^{th}$, $84^{th}$, $91^{st}$, $98^{th}$, and $105^{th}$ peg holes. Each of donut! circles on track two are green in colour.

The first donut! circle on track three begins on the $17^{th}$ peg hole 6.7 after this start/finish line. All subsequent donut! circles on the track occur on the $24^{th}$, $31^{st}$, $38^{th}$, $45^{th}$, $52^{nd}$, $59^{th}$, $66^{th}$, $73^{rd}$, $80^{th}$, $87^{th}$, $94^{th}$, and $101^{st}$ peg holes. Each of the donut! circles on track three are blue in colour.

The first donut! circle on track four begins on the $22^{nd}$ peg hole 6.8 after this start/finish line. All subsequent donut! circles on this track occur on the $29^{th}$, $36^{th}$, $43^{rd}$, $50^{th}$, $57^{th}$, $64^{th}$, $71^{st}$, $78^{th}$, $85^{th}$, $92^{nd}$, $99^{th}$, and $106^{th}$ peg holes. Each of the donut! circles on track four are red in colour.

In the illustration of FIG. 1, it should be noted that it was advantageous to numerically stagger the alignment of the donut! circles on each of the four pegging tracks of the invention because:

a) It allows for a number of different game possibilities in the forwards or backwards pegging direction.
b) It allows for an attractive looking peg board as the different coloured donut! circles appear to be randomly scattered across the peg board on the four pegging tracks.
c) It allows for more board space between the peg holes to draw, imprint, or countersink the donut! circles around their designated peg holes.

In both start/finish areas 3, eight peg holes are specifically designated as the starting points 7 for the pegs, and the other three peg holes 8 complete the final singular pegging track at the finish of the game. Each of the four pair of starting points 7 on both sides of the peg board are colour coded to correspond with the donut! circles on the pegging tracks they line up with. For example:

a) All of the donut! circles on track one 6.1 are yellow in colour. Therefore the two starting points 7.1 that line up with this track are also yellow in colour.
b) All of the donut! circles on track two 6.2 are green in colour. Therefore the two starting points 7.2 that line up with this track are also green in colour.
c) All of the donut! circles on track three 6.3 are blue in colour. Therefore the two starting points 7.3 that line up with this track are also blue in colour.
d) All of the donut! circles on track four 6.4 are red in colour. Therefore the two starting points 7.4 that line up with this track are also red in colour.

When a player pegs a game on track one (the yellow donut! circle pegging track), this player would also use yellow coloured pegs for colour congruency. The same is true in regard to the three other pegging tracks: The player who pegs on track two (the green donut! circle track) uses green pegs, the player who pegs on track three (the blue donut! circle track) uses blue pegs, the player who pegs on track four (the red donut! circle track) uses red pegs. In the case where there are more than 4 players for the game, colour congruency between the pegs and the tracks for the $5^{th}$ and $6^{th}$ players is not necessary, nor is it possible.

In the "SHORT VERSION" game of donuts!, one start/finish area 3 is designated as the starting area, and the other start/finish area 3 on the opposite side of the peg board is the designated finishing area for the game.

In the "LONG VERSION" game of donuts!, only one of the start/finish areas 3 acts as both the starting area and the finishing area for the game. The reason for this is because in the LONG VERSION game, all players peg from one side of the peg board to the other side and back again. For example: If players play a LONG VERSION forwards game in the forwards direction, then the start/finish area on the letter "d" becomes the designated starting area and finishing area for the game.

When a start/finish area 3 is designated as a finishing area, all eleven peg holes within this finishing area act as a singular pegging track at the finish of the game. When a start/finish area has been designated as the starting area, eight of the eleven peg holes within this starting area are used as starting points 7 for the pegs, and the other three remaining peg holes 8 are not utilized.

In FIG. 1, one hole 9 which is 5/16 of an inch in diameter on the exclamation mark ("!") of the peg board may be utilized as a pen holder for the game, and is drilled completely through the peg board at a depth of ¾ of and inch. There are two holes 10 which are ⅞ of an inch in diameter found on the "d" and the "o" of the word donuts! on the peg board. They may be utilized as dice holders for the game. These holes are drilled completely through the peg board at a depth of ¾ of an inch. When the dice are temporarily stored in these holes during game play, the peg board can be gently lifted up on the "d" side of the board to easily remove a die or the dice from these holes as required.

Figure 2:
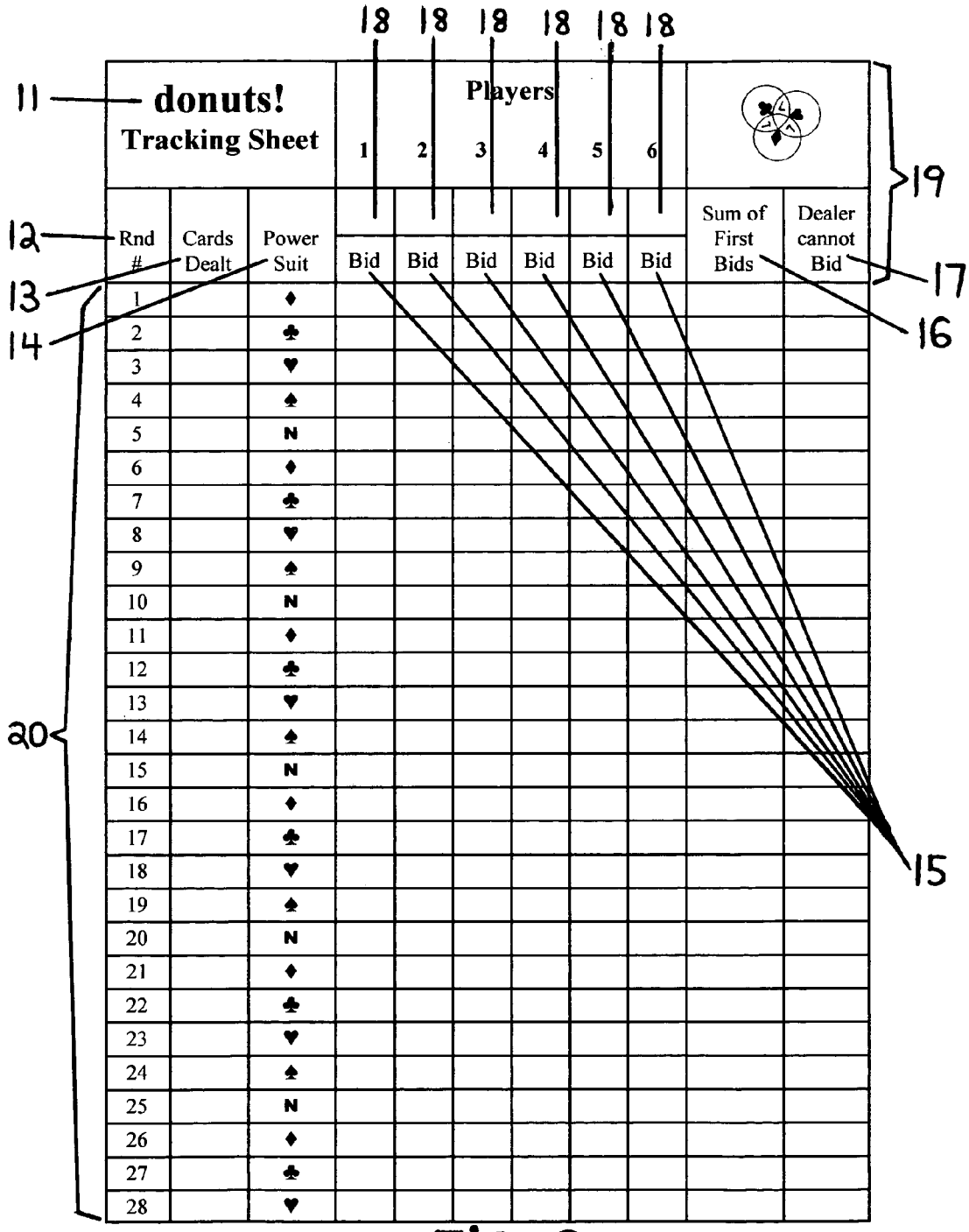

The drawing in FIG. 2 illustrates embodiments of the donuts! Game Tracking Sheet 11 of the invention. Each game tracking sheet is made from one individual sheet of paper that is bonded together with a plurality of other tracking sheets to make up an entire pad of sheets. The pad size for these tracking sheets is 8 and ½ inches in length by 5 and ½ inches in width by 3/16 of an inch in height.

Each donuts! game tracking sheet is made up of a number of columns and rows. The numbers within the first column 12 under the heading "Rnd #" identify each round of play in proper numerical sequence. The blank areas within the second column 13 under the heading "Cards Dealt" are utilized to document how many cards are dealt to each player in each round of play. In the game of donuts!, the number of cards dealt to each player changes by 1 numerical value (or by 1 card) from one round of play to the next as the game progresses. The "Cards Dealt" column 13 is manually completed by one of the players before the game begins according to the instructions in the rule book.

The card suit symbols in the third column 14 under the heading "Power Suit" identify which suit is the power suit for each round of play. The blank areas within the fourth, fifth, sixth, seventh, eighth and ninth columns 15 under the headings "Bid" are utilized to document each player's bid in each round of play. The blank areas within the tenth column 16 under the heading "Sum of First Bids:" are utilized to document the sum of every player's bid except for the dealer's bid in each round of play. The blank areas within the eleventh column 17 under the heading "Dealer cannot Bid:" are utilized to document the number of tricks the dealer cannot bid in each round of play. Since the dealer cannot bid for this particular number of tricks in the round, he or she offsets the bidding total from the trick total for that round. This ensures that at least one player will not make their bid at the end of every round of play.

In FIG. 2 below the heading "Players 1 2 3 4 5 6" within game information area 19, are blank areas 18 where the names or the initials of all players are documented on the game tracking sheet. The game information area 19 across the entire top of the tracking sheet includes an area for the donuts! game logo, and information areas labeled "Players 1 2 3 4 5 6", "donuts! Tracking Sheet", "Rnd #", "Cards Dealt", "Power Suit", "Bid", "Sum of First Bids", and "Dealer cannot Bid". The game tracking area 20 stretches across the rest of the game tracking sheet underneath the game information area 19 and is utilized to keep track of the game.

Figure 3:
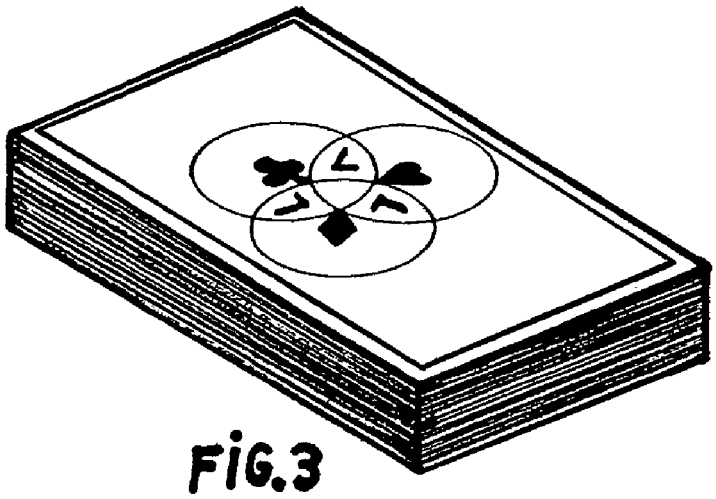
Figure 4:
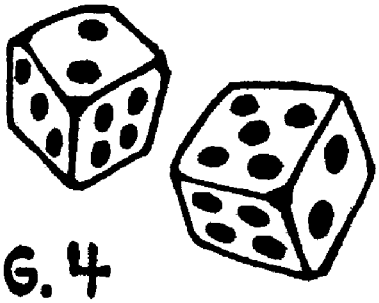
Figure 5:
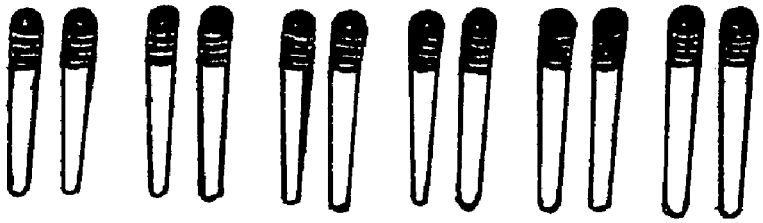
Figure 6:
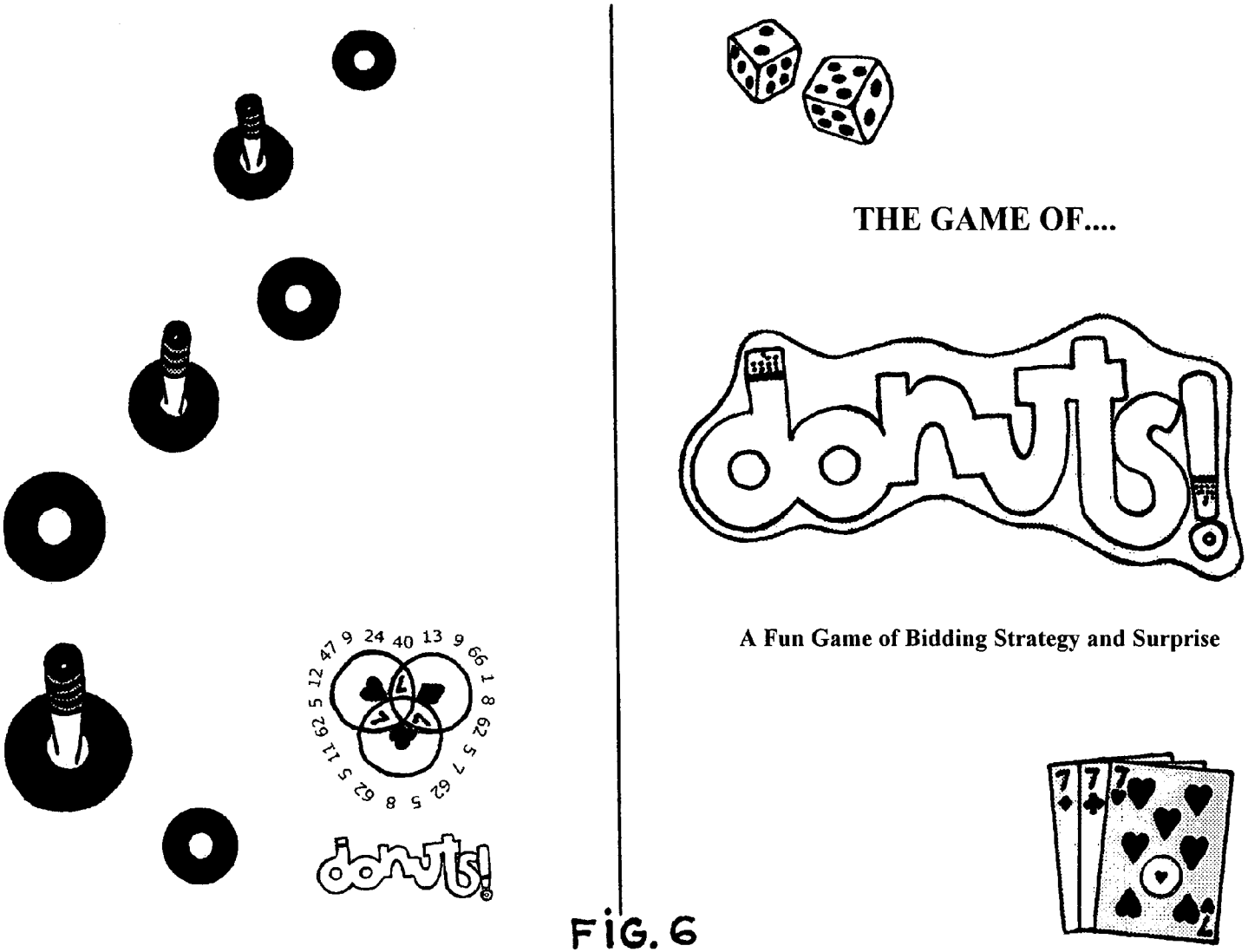
Figure 6B:
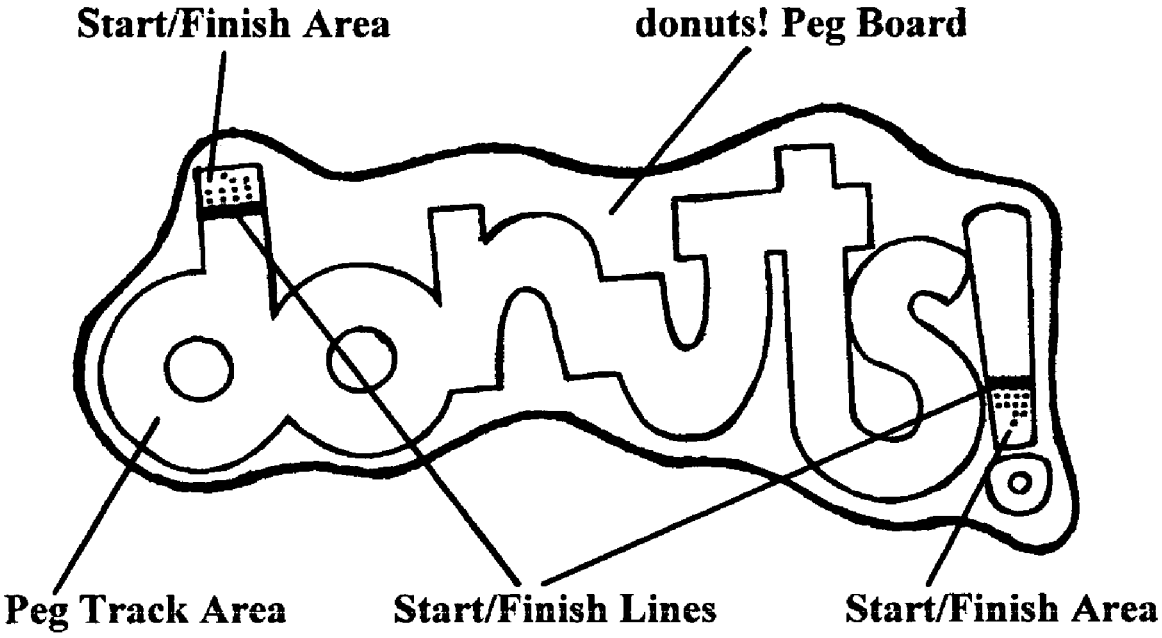

The drawing in FIG. 3 illustrates a deck of 52 cards consisting of 4 aces through 4 duces that are used by all players to play the game. The drawing in FIG. 4 illustrates one pair of dice used by all players to play the game. The drawing in FIG. 5 illustrates six different pairs of coloured pegs used by players to play the game. The drawing in FIG. 6 illustrates the front and back cover of the rule book. The drawing in FIG. 6A illustrates a 4 player Game Tracking Sheet in progress as depicted on page nine of the rule book. The drawing in FIG. 6B illustrates the donuts! peg board diagram as depicted on page fifteen of the rule book. The drawing in FIG. 6C illustrates a 3 and 4 player Game Tracking Sheet as depicted on page sixteen of the rule book. The drawing in FIG. 6D illustrates the 5 player Game Tracking Sheet as depicted on page seventeen of the rule book. The drawing in FIG. 6E illustrates the 6 player Game Tracking Sheet as depicted on page eighteen of the rule book.

The following nineteen pages (from pages 14 to 34) provide a detailed description of the written contents of the rule book component of the invention excluding it's table of contents, diagrams, and illustrations.

The Game of . . . donuts!

Game Contents 1 donuts! Peg Board
1 donuts! deck of Playing Cards
1 pad of donuts! Game Tracking Sheets
1 donuts! Rule Book
1 set of Dice
6 sets of Pegs Object of the Game To determine the best possible bid in each round of play in order to make your bid.

To make your bid in each round of play in order to obtain pegging points so as to advance your position on the peg board.

To try and land on donut! circles on the peg board and/or capture donut! 7 cards in order to obtain extra pegging points.

To be the first player to cross the FINISH line on the peg board to win. In the case where two or more players cross the FINISH line at the same time (on the same turn), the object of the game is to be the player who pegs the farthest past the FINISH line to win.

Preperation to Play the 4 Player Game

5. Remove the donuts! peg board, the playing cards, the dice, and the pegs from the box.
6. Place the donuts! peg board in one of the corner areas of the table pointing towards the centre of the table. This allows for good card play and yet gives all players the ability to see the peg board.
7. Tear off one game tracking sheet from the game tracking sheet pad to keep track of the game.
8. Write the names or initials of each player on the game tracking sheet.
5. Place four sets of coloured pegs into the congruent colour coded starting positions within one START/FINISH area. NOTE: In the game of donuts! you can START at either end of the peg board. For details see the instructions under the heading of "FORWARDS OR BACKWARDS PLAY OPTION" on page 4.

How to Choose the Dealer and the Game Tracker

1. In the game of donuts! one player usually volunteers to keep track of the game. This person is called the "Game Tracker". If no one volunteers to be the Game Tracker, then each player rolls the dice. The player who rolls the highest number keeps track of the game. Once decided, the "Game Tracker" is responsible to write the game information on the tracking sheet, and keep track of each player's bid until the game is finished. At the end of each round of play, the game tracker documents who made their bid and who did not. Players who make their bid get 10 points added to their bid to produce a pegging score. This score is then pegged on the donuts! peg board. Players who do not make their bid "get a donut!" on the tracking sheet which looks like a number of scribbled circles that scratch out the player's bid. This indicates that these players did not make their bid and as a result they do not get to score pegging points on the peg board.
2. To choose the dealer for Round 1, each player rolls the dice once. The player who rolls the highest number on the dice becomes the dealer for Round 1.
3. In subsequent rounds the dealing responsibility always moves to the next player on the dealer's left. (Or clockwise from player to player from one round to the next).

Short Version or Long Version Game Option

Before starting the game of donuts!, players must decide whether or not they are going to play a SHORT VERSION game or a LONG VERSION game.

In the SHORT VERSION game, players peg their way once through the entire board to the FINISH line on the other side of the board. In the LONG VERSION game players peg their way twice through the board from one side of the board back to where they originally started from.

In the SHORT VERSION game, approximately 12 to 15 rounds are played, in a LONG VERSION game typically 24 to 27 rounds are played.

Forwards or Backwards Play Option

Before starting a game of donuts! all players must decide whether they are going to play the FORWARDS game or BACKWARDS game on the peg board.

If everyone chooses to play a FORWARDS game, all players start at the front of the peg board on the letter "d" before the START/FINISH line. Pegs are placed in the proper colour coded starting holes.

If a BACKWARDS game is chosen, all players start at the back of the peg board on the exclamation mark (!) before the START/FINISH line. Pegs are placed in the proper colour coded starting holes.

Peg Board Track Option

There are 4 pegging tracks on the peg board. Players must choose their track by rolling the dice rather than claiming the track they want to play on. The player who rolls the highest number on the dice gets to choose their track first. Consequently the player who rolls the next highest number chooses their track and so on until all 4 players have a track. The player on the yellow donut! circle track, uses yellow coloured pegs for colour congruency. Consequently, the player on the green track uses green pegs, the player on blue uses blue pegs, and the player on red uses red pegs.

How to Set Up the Game Tracking Sheet

Before starting the 4 player game, the names of the players are entered onto the tracking sheet and the tracking sheet is completed by the Game Tracker as shown on page 16. For the 4 player game, make sure to document the number of cards dealt to each player according to the Game Tracking model on page 16.

Shuffling and Dealing

1. Before each round of play, the cards are shuffled well by the dealer and are dealt out to the players.
2. In Round 1 of the 4 player game, 13 cards are dealt to each of the 4 players which disperses the entire deck of 52 cards. In Rounds 2, 3 and 4 (and so on), the number of cards dealt to each player changes by one numerical value from one round to the next. In the $2^{nd}$ round of play, 12 cards are dealt to each player, in the $3^{rd}$ round 11 cards are dealt out, in the $4^{th}$ round 10 are dealt to each player and so on (See the donuts! Tracking Sheet on page 16). NOTE: The extra cards that are not dealt out are placed off to the side of the table face down, and are not to be seen by any of the players during the entire round.

Bidding

After the cards are dealt out, the player left of the dealer makes a bid in regard to how many tricks he or she thinks they can take in the 1st round of play. In the same way the next player to the left makes his or her bid, and the process repeats itself from one player to the next until it is the dealer's turn to bid. All bids are entered onto the game tracking sheet under each player's name.

The Dealer's Bid

In the game of donuts!, the dealer cannot freely bid any number of tricks he or she desires (like the other players). There is one restriction to dealer's bid. Below is a bidding example in the 1st round where 13 cards are dealt out to each player to make a Trick total of 13 for the round:

Player 1 left of the dealer bids 5 which indicates he feels he can take 5 tricks Player 2 left of player 1 bids 2 which indicates she feels she can take 2 tricks Player 3 left of player 2 bids 3 which indicates she feels she can take 3 tricks Player 4 (the dealer) cannot bid 3 as this produces a Bidding Total of 13.

Bid total cannot=13

Note: If the dealer bids 3 then the Bidding Total of all players=13, and the Trick total=13. In the game of donuts! the dealer must offset these totals with his bid (with a helpful reminder from the Game Tracker).

In the example above the dealer could bid 2 for 2 tricks or 4 for 4 tricks, but he cannot bid 3 for 3 tricks because if he does, there is the possibility that every player could make their bid in this round of play.

Offset Bidding Rule

In the game of donuts! there must always be at least one player who does not make their bid at the end of the round. Therefore, when it's the dealer's turn to bid, he or she must Offset the Bidding Total from the Trick total by at least one (1) numerical value (or by 1 trick) to accomplish this. To offset the bid, the Bid total and the Trick total cannot be the same.

Here is another bidding example where 9 cards (for a trick total of 9) was dealt to each of the 4 players in round #5.

Player 1 left of the-dealer bids 3 which indicates he feels he can take 3 tricks Player 2 left of player 1 bids 2 which indicates she feels she can take 2 tricks Player 3 left of player 2 bids 0 which indicates she feels she can take 0 tricks Player 4 (the dealer) cannot bid 4 as this produces a Bidding Total of 9.

Bid total cannot=9

Consequently, if the dealer bids 4, then the Bidding Total=9 and the Trick Total=9. Again, these totals cannot be the same.

In this example the dealer could bid 3, or less than 3, or 5, or more than 5, but he cannot bid 4 for 4 tricks as every player could potentially make their bid. Note: It doesn't matter whether the dealer offsets the Bidding total from the Trick total by a numerical value of 1(one), 2 (two) or 3 (three), just as long as he offsets it by one of these values.

Maximum Bid Offset

The maximum bid offset in regard to the Dealer's bid is a value of three (3) in either direction of the bidding total.

The Dealer's Bid in Round 13 of the 4 Player Game

Unlike every other round in the 4 player game, in round 13 the dealer is not restricted in his/her bid. He or she can freely bid either one (1) for one trick, or zero (0) for zero tricks. As a result, all players in this round can potentially make their bid. NOTE: Round 13 is the only round in the 4 player game where the dealer can freely bid in this manner. Please see the rules for this round of play on Page 10 under "ONE CARD PLAY in Round 13".

Regular Game Play in the 4 Player Game

Once the bidding is finished, the player left of the dealer starts game play by leading a card in the first turn of play. Play always moves in a clockwise direction from one player to the next. Each player plays one card until all have finished. If a card from the suit of spades is led, then all the other players have to follow suit and play spades from their hand (if they have spade cards to play). In this example the player who plays the highest spade card takes all the cards for a trick. After taking the trick, this player sets his trick off to the side face down on the table, and then leads another card from his hand to start another turn of play. Note: If players do not have spade cards in their hand after spades is led, then they have 2 options of play:

they can play a power suit card in an attempt to take the trick, or they can throw out (or sluff) a card from another suit.

Play continues from one turn of play to the next until all of the cards are played out at the end of the round. Once the round is over, each player counts his tricks to determine if they have made their bid. Players who make their bid get to score pegging points on the peg board. Below are 3 examples of game play in the 4 player game of donuts!.

EXAMPLE 1

Here is a turn of play where spades (♠) is the power suit. Because diamonds was led first, all players have to play diamond cards if they have them in their hand.

Player 1 leads the 2 of diamonds.

Player 2 plays the 5 of diamonds.

Player 3 plays the 10 of diamonds in an attempt to take the trick.

Player 4 plays the 4 of spades power card as he has no diamond cards.

The Result:

Player 4 wins the trick as his 4 of spades is a power card and is therefore the highest card in the turn. Player 4 now leads a card to start the next turn.

EXAMPLE 2

Here is a turn of play where hearts (♥) is the power suit. Because hearts was led first, all players must play hearts if they have them in their hand.

Player 1 leads the King of hearts.

Player 2 plays the lack of hearts.

Player 3 plays the 6 of clubs as he does not have hearts in his hand.

Player 4 plays the 8 of hearts.

The Result:

Player 1 wins the trick as his King of hearts is the highest power card in the turn. Player 1 now leads a card to start the next turn of play.

EXAMPLE 3

Here is a turn of play where diamonds (♦) is the power suit.

Player 1 leads the Queen of clubs.

Player 2 plays the 9 of clubs.

Player 3 plays the 4 of clubs.

Player 4 plays the 7 of clubs.

The Result:

Player 1 wins the trick as his Queen of clubs is the highest card in the turn. Even though diamonds was the power suit, all players played clubs because they had club cards in their hand. Player 1 now leads a card to start the next turn of play.

Power Suit Play

When a power suit card is led in any given round, all other players must follow suit and play power suit cards if they have them in their hand. Power suit cards can be:

1. led in order to draw out other power suit cards from other players in strategic play.
2. played when you are out of the suit that has been led.

The "No Power" Round of Play

When "No Power" (N) is specified for the round on the tracking sheet, there is no designated power suit during game play. As a result, the highest card of any suit led takes the trick. Consequently all players must follow suit in the "No Power" round if they can do so. If they cannot follow suit, they must throw out (or sluff) some other card from some other suit of their choosing. Below are 2 examples of game play in the "No Power" round:

EXAMPLE 1

Because clubs (♣) was led first in this "No Power" round, all players must play clubs if they have them in their hand.

Player 1 leads the King of clubs.

Player 2 plays the 7 of clubs.

Player 3 plays the 4 of hearts as he has no clubs in his hand.

Player 4 plays the 7 of diamonds as she has no clubs in her hand.

The Result:

Player 1 wins the trick as his King of clubs is the highest card in the turn.

EXAMPLE 2

Spades (♠) is led first. Because spades was led first, all players must play spades if they have them in their hand.

Player 1 leads the 2 of spades.

Player 2 plays the 5 of diamonds.

Player 3 plays the 10 of spades in an attempt to take the trick.

Player 4 plays the 4 of hearts.

The Result:

Player 3 wins the trick as his 10 of spades is the highest card in the turn.

4 player Game EXAMPLE Tracking Sheet—In Progress On Pg. 9 of Rule Book (See FIG. 6A)

One Card Play in Round 13 of the 4 Player Game

In Round 13 each player is dealt one card. NOTE: The way in which round 13 is played in the 4 player game is completely opposite to every other round. Instead of players looking at their card and bidding on it, each player quickly holds their card up to their forehead without looking at it and in unison say, "Who gets the donut!?" After doing this, all players view every other player's cards while holding their own card to their forehead and proceed to make their bid according to what cards every other player has. The player left of the dealer starts the bidding.

As mentioned earlier, in Round 13 the dealer is not restricted in his bid. He or she can freely bid one (1) for one trick, or zero (0) for zero tricks. As a result, all players could potentially make their bid. NOTE: Round 13 is the only round in the entire 4 player game where the dealer does not have to offset the bidding total from the trick total.

Scoring

When a player makes their bid, the Game Tracker adds 10 points to their bid on the tracking sheet to come up with their pegging score. To do this the Game Tracker places a 1 (one) in front of the bid. Thus a bid of 3 becomes a score of 13. Players who do not make their bid "get a donut!" which is a number of scribbled circles that scratch out their bid on the tracking sheet. Here are some examples:

A player bids 2 and makes their bid, add 10 to it—they get 12 pegging points

A player bids 1 and makes their bid, add 10 to it—they get 11 pegging points

A player bids 4 and does not make their bid—they "get a donut!" like this

A player bids 3 and does not make their bid—they "get a donut!" like this

Players who make their bid get to peg their points on the donuts! peg board. Players who do not make their bid do not get to peg any points. Instead they "get a donut! on the tracking sheet as illustrated above.

Donut! Circle Scoring on the Peg Board

Players who land on donut circles on their pegging track get to roll both dice for extra pegging points. For example:

If a player rolls "3" after landing on a donut circle, this player pegs 3 spaces forward and stops rolling.

If a player rolls "12" after landing on a donut circle, this player pegs 12 spaces forward and stops rolling.

Once players have finished pegging these extra points, game play continues.

Rolling "7" on the Dice

When a player rolls a "7" after landing on a donut circle, they move 7 spaces forward on the peg board. In doing so, they "hit" another donut! circle on their pegging track and have the privilege of rolling again. If they roll another "7" they peg these points on the peg board and roll both dice again. This continues until they stop rolling sevens.

7 ♦ 7 ♣7 ♥—Those 3 donut! Cards

Three cards in the deck have "donuts!" imprinted on them: The 7 of Diamonds, the 7 of Clubs and the 7 of Hearts. Right after a player captures one of these cards in a trick, they have the privilege of rolling one die to try and "hit a donut!" on their pegging track. If a player "hits a donut!" on their pegging track they can now roll both dice to try and hit another donut! circle. If a player rolls one die and does not "hit a donut" they peg the number of points rolled and stop rolling. Card play resumes.

Winning the Game

To win the game you must be the first player to cross the FINISH line determined at the beginning of the game. In the case where two or more players cross the FINISH line at the same time, the player who pegs the farthest on the final pegging track after crossing the FINISH line wins the game.

Helpful Hints in Playing the Game of donuts!

1. When bidding in the game of donuts!, focus on making a bid that you honestly think you can make for that round. If you feel you can stretch your bid to "hit a donut!" circle on the peg board, then it's up to you to make that decision. However, if you stretch your bid too much in an attempt to "hit a donut!" on the peg board, chances are you will not make your bid, and you won't hit the donut circle on the peg board either! When this happens, you'll quickly change the name of this game to doNUTs!
2. Note: The possibility of a player hitting a donut! circle on the peg board at random is about once per game. In other words, be encouraged! You should be able to hit a donut! circle without even trying to! The thinking on this advice is: "If I can just make my bid, . . . I actually get to peg some points!"
3. In the SHORT VERSION game, the bidding becomes a more difficult as the rounds progress and fewer cards are dealt out to each player. Typically cards of lower value, such as Queens, Jacks and 10's, become more powerful in taking tricks. In-the LONG VERSION game this process starts to reverse itself after the game moves beyond round 13.
4. Do not become frustrated if you don't make your bid . . . everyone "gets the 'scribbled' donut!" on the tracking sheet sooner or later. Sometimes more than one player gets this type of donut! in the same round. This is normal, and yet for other players it can be refreshing.
5. During Round 13, make sure there are no mirrors on the wall in the room. The tendency for some players to want to see the card on their forehead is strong. Also watch out for windows or glass in the area, or for players who wear glasses. These reflective items can throw this crucial round "out the window" so to speak.
6. Even though the MAXIMUM BID OFFSET is three (3), its better practice for the dealer to not offset the bid too much (too often). The reason: Overall, it seems to produce a better game that's just more fun!
7. Feeding the donut! 7 cards to players who are really 'hungry' is always the best policy when possible. If you feed these donut! cards to players who are already in the lead, you'll just 'puff' them up even more!
8. When playing the game of donuts!, the best hand to have is the one where you have a number of very high cards, and a number of very low cards. Hint: Often it's the cards in the middle that cause players to "get the donuts!" on the tracking sheet. If this happens to you, administer a quick sugar fix and try to ensure other players get these same type of donuts! too . . . just as quickly as you can . . . before the round ends.

Other donuts! Games

Sevens Move Seven

In the Sevens move Seven game, instead of rolling one die, players automatically peg 7 points on the peg board when they capture donut! 7 cards. All the other rules of the game remain the same.

Tricks Move the Sticks

In the Tricks move the Sticks game, donut! 7 cards are not applicable for scoring. Instead, at the end of each round players who get "the scribbled donut!" can peg points in relationship to the number of tricks they actually took. For example: If a player captures a total of 4 tricks at the end of the round but "got a donut!", they peg 4 points on the pegboard as consolation. If a player "hits a donut!" circle while pegging these points they can roll both dice for more points. All the other rules of the game remain the same.

The Card Player'S Game

In the Card Players Game, players have to make their bid, or hit donut! circles after making their bid to peg points. As such, players cannot obtain extra pegging points for capturing donut! 7 cards or by counting tricks at the end of the round as a consolation. All the other rules of the game remain the same.

Game Play with 3, 5, or 6 Players

The 3 Player Game

In the 3 player game, the dealer must reduce the deck to 39 playing cards. To do this the dealer removes the following cards from the deck:

Remove all 2's, 3's and 4's from each suit and the 5 of spades from the spades suit.

Setting Up the Tracking Sheet for 3 Players

To set up the Tracking Sheet for the 3 player game, please see the model example on page 16.

The 5 Player Game

In a 5 player game the dealer must reduce the deck to 50 playing cards. To do this the dealer removes the following 2 cards from the deck:

Remove the 2 of diamonds and the 2 of clubs from the deck.

Track Selection with 5 Players

Note: Because there are only 4 tracks on the donuts! peg board, one of the 5 players will have to peg in the opposite direction of everyone else on one of the 4 tracks. The player who rolls the lowest number on the dice out of all 5 players chooses one of the 4 tracks to play on going in the opposite direction.

Setting Up the Tracking Sheet for 5 Players

To set up the Tracking Sheet for the 5 player game, please see the model example on page 17.

On the Tracking Sheet example at Round 1, 10 cards are dealt to each of the 5 players. When setting up the Game Tracking Sheet for the 5 player game, the Game Tracker must document the Tracking Sheet according to the example on page 17. It should also be noted that 1 card play now occurs at Round 10, not at Round 13 like it does in the 3 or 4 player game.

The 6 Player Game

In a 6 player game the dealer must reduce the deck to 48 playing cards. To do this the dealer removes the following 4 cards from the deck:

Remove all of the 2's from each suit.

Track Selection for the 6 Player Game

Note: Because there are only 4 tracks on the donuts! peg board, two of the 6 players in this game will have to peg in the opposite direction of everyone else on two of the 4 tracks. The player who rolls the lowest number of all 6 players chooses 1 of the 4 tracks going in the opposite direction first. The player who rolls the second lowest number of all 6 players chooses 1 of the 3 remaining tracks going in the opposite direction.

Setting Up the Tracking Sheet for 6 Players

To set up the Tracking Sheet for the 6 player game, please see the model example on page 18.

Notice on the Tracking Sheet example that at Round 1, 8 cards are dealt to each of the 6 players. When setting up the Game Tracking Sheet for the 6 player game, the Game Tracker must document the Tracking Sheet according to the example on page 18. It should also be noted that 1 card play now occurs at Round 8, not at Round 13 like it does in the 3 or 4 player game.

APPENDICES

| | |
|---|---|
| The donuts! PEG BOARD | 15 |
| The 3 and 4 player GAME TRACKING SHEET | 16 |
| The 5 player GAME TRACKING SHEET | 17 |
| The 6 player GAME TRACKING SHEET | 18 |

-The donuts! Peg Board-
On Pg. 15 of Rule Book
(See FIG. 6B)
-3 and 4 player Game Tracking Sheet-
On Pg. 16 of Rule Book
(See FIG. 6C)
-5 player Game Tracking Sheet-
On Pg. 17 of Rule Book
(See FIG. 6D)
-6 player Game Tracking Sheet-
On Pg. 18 of Rule Book
(See FIG. 6E)
(End of Rule Book)

The drawing in FIG. 7. illustrates the three donut! cards used in the game. The three donut! cards in the deck are specifically the seven of diamonds, the seven of clubs and the seven of hearts. Note that the donut! imprints 21 are stamped or drawn right onto the inside face of all three cards as shown in FIG. 7. The drawing in FIG. 8 illustrates the donuts! game logo.

I claim:

1. A donuts! peg board made from wood or from molded or injected plastic material consisting of:

a. a plurality of peg holes on four pegging tracks that wind across the peg board within an outline of the game's name;

b. two start/finish lines where one start/finish line is located on the letter "d" of the peg board, and the other start/finish line is located on the exclamation mark ("!") of the peg board;

c. a start/finish line located on the letter "d" that consists of one thick black horizontal line that separates the four pegging tracks below this line, from the start/finish area above this line;

d. a start/finish line located on the exclamation mark ("!") that consists of one thick black horizontal line which separates the four pegging tracks above this line from the start/finish area below this line;

e. two start/finish areas where one start/finish area is located on the letter "d" on the peg board, and the other start/finish area is located on the exclamation mark ("!") on the peg board;

f. a start/finish area located on the letter "d" of the peg board that consists of eleven peg holes;

g. Eleven peg holes within the start/finish area on the letter "d" that are connected to one another by a line to comprise one singular pegging track;

h. a start finish area on the letter "d" wherein eight of the said eleven peg holes comprise starting points for the pegs in any FORWARDS game;

i. a start finish area on the letter "d" wherein three of the said eleven peg holes comprise and complete a singular pegging track utilized at the finish of a game;

j. a start/finish area located on the exclamation mark (!) of the peg board that consists of eleven peg holes;

k. Eleven peg holes within the start/finish area on the exclamation mark ("!") that are connected to one another by a line to comprise one singular pegging track;

l. a start/finish area on the exclamation mark (!) wherein eight of the said eleven peg holes comprise starting points for the pegs in any BACKWARDS game;

m. a start/finish area on the exclamation mark (!) wherein three of the said eleven peg holes comprise and complete a singular pegging track utilized at the finish of a game;

n. a plurality of donut! circles that surround a plurality of peg holes on each of the four pegging tracks;

o. a circular black line that forms the dot of the exclamation mark ("!") on the peg board;

p. a plurality of peg holes on each pegging track that are connected by a line to comprise four separate and distinct pegging tracks;

q. four (4) separate and distinct pegging tracks which include thirteen (13) donut! circles along the length of each track;

r. Thirteen (13) donut! circles on each pegging track that are separated from each other by 6 unmarked peg holes;

s. thirteen (13) donut! circles on pegging track one starting from the start/finish line on the letter "d" that occur on the $18^{th}$, $25^{th}$, $32^{nd}$, $39^{th}$, $46^{th}$, $53^{rd}$, $60^{th}$, $67^{th}$, $74^{th}$, $81^{st}$, $88^{th}$, $95^{th}$, and $102^{nd}$ peg holes;

t. thirteen (13) donut! circles on pegging track two starting from the start/finish line on the letter "d" that occur on the $16^{th}$, $23^{rd}$, $30^{th}$, $37^{th}$, $44^{th}$, $51^{st}$, $58^{th}$, $65^{th}$, $72^{nd}$, $79^{th}$, $86^{th}$, $93^{rd}$, and $100^{th}$ peg holes;

u. thirteen (13) donut! circles on pegging track three starting from the start/finish line on the letter "d" that occur on the $20^{th}$, $27^{th}$, $34^{th}$, $41^{st}$, $48^{th}$, $55^{th}$, $62^{nd}$, $69^{th}$, $76^{th}$, $83^{rd}$, $90^{th}$, $97^{th}$, and $104^{th}$ peg holes;

v. thirteen (13) donut! circles on pegging track four starting from the start/finish line on the letter "d" that occur on the $15^{th}$, $22^{nd}$, $29^{th}$, $36^{th}$, $43^{rd}$, $50^{th}$, $57^{th}$, $64^{th}$, $71^{st}$, $78^{th}$, $85^{th}$, $92^{nd}$, and $99^{th}$ peg holes;

w. an outline on the peg board that is comprised of one black line to form the shape of the game's name of donuts!.

* * * * *